United States Patent [19]

Strumbos

[11] Patent Number: 4,810,929

[45] Date of Patent: Mar. 7, 1989

[54] SPARK PLUG TEMPERATURE CONTROL

[76] Inventor: William P. Strumbos, 85 Middleville Rd., Northport, N.Y. 11768

[21] Appl. No.: 219,826

[22] Filed: Jul. 15, 1988

Related U.S. Application Data

[63] Continuation-in-part of Ser. No. 31,766, Mar. 30, 1987, abandoned.

[51] Int. Cl.[4] ..... H01T 13/16

[52] U.S. Cl. ..... 313/11.5; 313/136; 313/143; 123/169 CL

[58] Field of Search ..... 313/11.5, 34, 132, 136, 313/143; 123/169 CL

[56] References Cited

U.S. PATENT DOCUMENTS

| | | | |
|---|---|---|---|
| 1,315,298 | 9/1919 | Genn . | |
| 2,096,250 | 10/1937 | Kasarjian . | |
| 4,361,122 | 11/1982 | Latsch | 123/266 |
| 4,394,855 | 7/1983 | Latsch et al. | 123/254 |
| 4,416,228 | 11/1983 | Benedikt et al. | 123/268 |
| 4,491,101 | 1/1985 | Strumbos | 313/143 X |
| 4,514,656 | 4/1985 | Damson et al. | 313/11.5 |

FOREIGN PATENT DOCUMENTS

| | | |
|---|---|---|
| 2025525 | 7/1978 | United Kingdom . |

*Primary Examiner*—David K. Moore
*Assistant Examiner*—K. Wieder

[57] ABSTRACT

A spark plug having a heat pipe incorporated in the center conductor assembly in the insulator centerbore. The heat pipe is thermally non-conducting below a design temperature such that the firing end of the spark plug retains heat to burn off fouling deposits. Above the design temperature range, a vaporizable medium in the heat pipe vaporizes such that its change of state extracts heat from the firing end, the vapor moving to the cooler part of the heat pipe and condensing to release its heat by a change of state. Capillary means running the length of the heat pipe returns the vaporizable medium to the firing end of the heat pipe. This circulation of the heat pipe medium which occurs when the firing end exceeds the design temperature transfers heat from the firing end to prevent its overheating. The heat pipe in the insulator thus controls automatically the operative heat range of the spark plug. In further embodiments, the walls of the insulator centerbore itself form the walls of the heat pipe and upper and lower walls therefor are defined within. Electrically conductive capillary wicking is used to insure electrical continuity or the center conductor shank extends through the heat pipe for the purpose. Means for using a tubular center conductor as the filling means for the heat pipe are also disclosed. In further embodiments, the insulator has a necked-in region filled with a material having high-thermal conductivity such that the heat dissipation characteristics of the device are enhanced.

25 Claims, 2 Drawing Sheets

FIG. 1
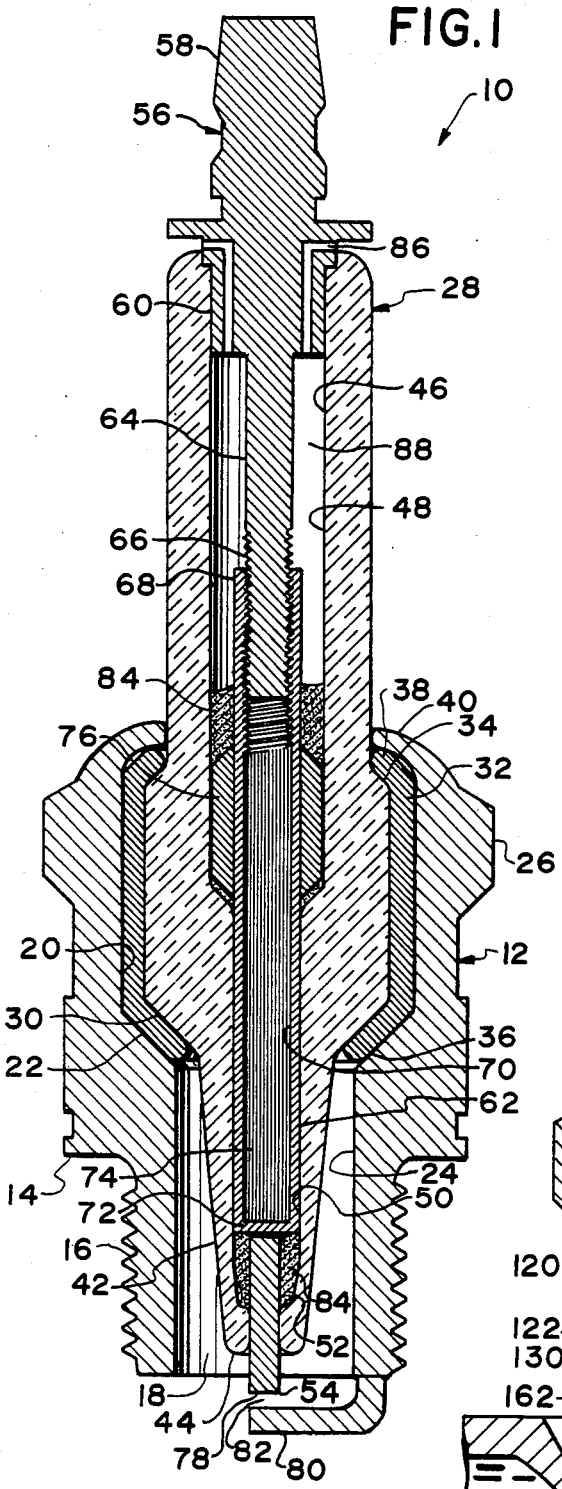
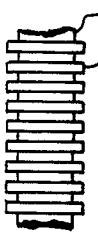
FIG. 2
FIG. 3
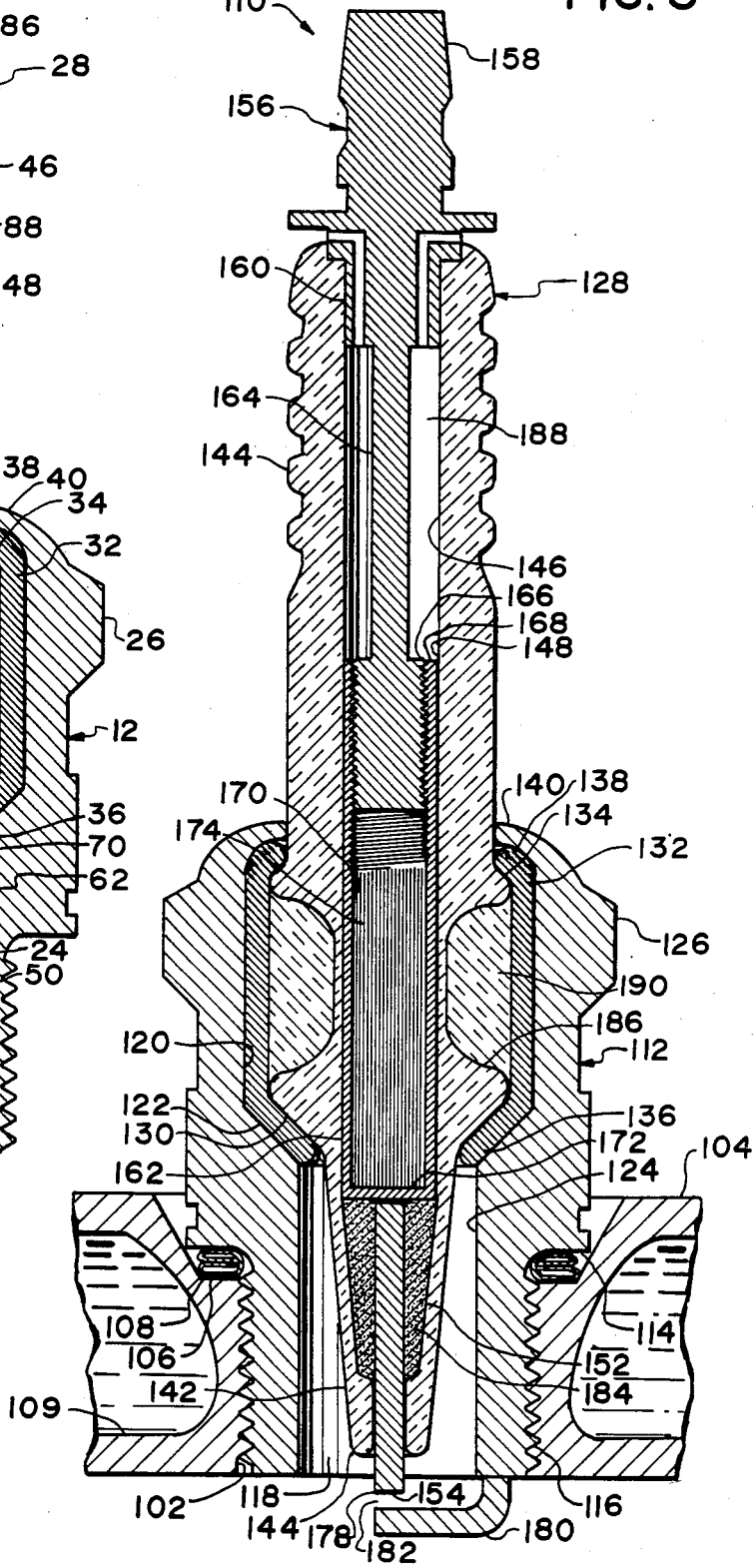

FIG. 4
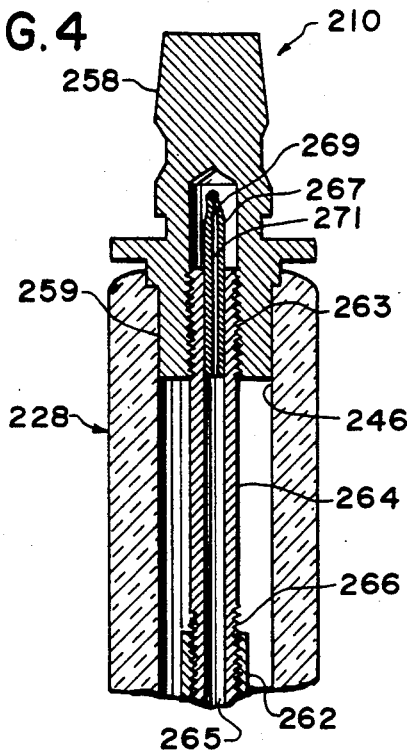
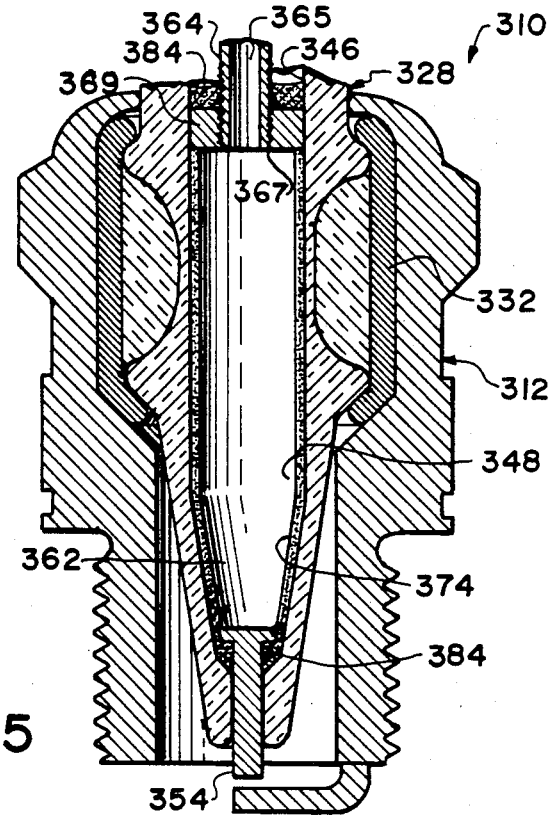
FIG. 5
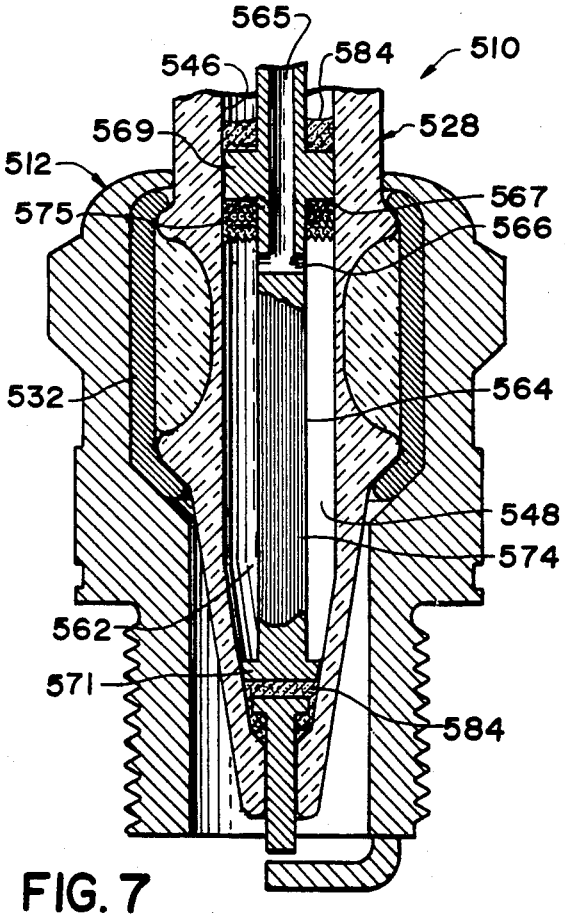
FIG. 7
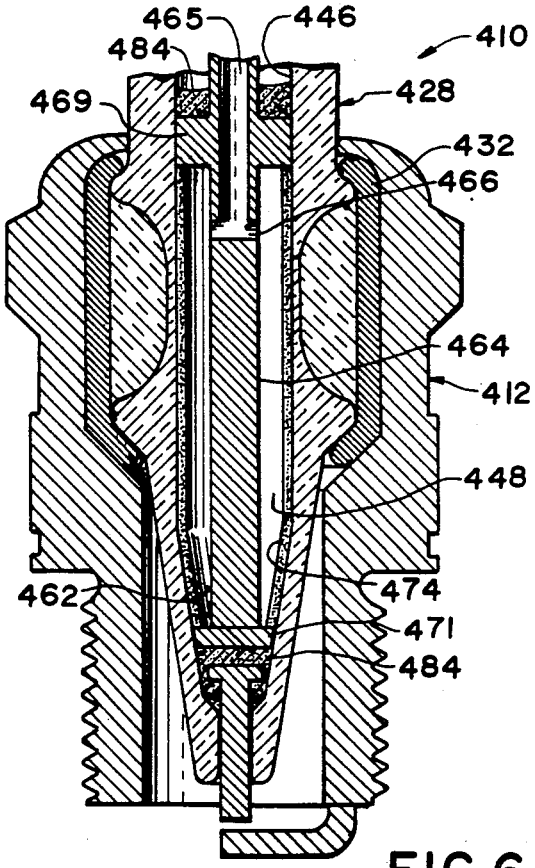
FIG. 6

SPARK PLUG TEMPERATURE CONTROL

This is a continuation-in-part of co-pending application Ser. No. 031,766, filed Mar. 30, 1987, and now abandoned.

FIELD OF THE INVENTION

This invention relates to spark plugs and spark igniters for internal combustion engines and, more particularly, to spark plugs and spark igniters which are provided with dynamic convective heat transfer means such as a heat pipe or a reflux condenser means to vary the operative heat range of the spark plug automatically.

BACKGROUND OF THE INVENTION

Spark plugs, particularly those in high-speed, high-compression engines, are subjected to an extreme range of pressure and temperature conditions. Plug temperatures range from about 200° C. at low engine speeds and light loads, to as high as 850° C. under full throttle, full load. Below about 450° C., carbon and other products of combustion begin to form on the plug insulator nose. If not removed, those deposits build up until current shorts through the deposits instead of sparking across the electrodes. At normal speeds, enough heat is usually generated to burn those deposits away as quickly as they are formed. However, when high speeds or heavy loads raise the plug temperatures above 600° C. to 700° C., deposits that have not been burned away, particularly those resulting from the additives in currently available fuels and lubricants, are melted to form a glaze coating on the plug insulator nose. When hot, this glaze is highly conductive and the plug is shorted out. This causes misfiring with consequent fuel and power losses. Should plug temperatures become excessive, the plug points themselves become hot enough to ignite the fuel-air mixture in the cylinder. This causes auto-ignition and, if continued, can lead to the destruction of the plug and serious engine damage. Overheated electrodes also cause a condition commonly met in two-stroke engines: the bridging of the electrodes due to the build-up of conducting deposits formed by combustion particles which have melted upon their striking the overheated electrodes. In plug temperatures ranges above 850° C., chemical corrosion and spark erosion cause plug failure within a very short time.

It will be seen then, if a hot-type plug is subjected to high compression Pressures, temperatures, and loads, electrode burning and auto-ignition will result because of the plug's slow rate of heat transfer. A cold plug, because it will not reach full operating temperature, will not tolerate low-speed, light-load operation for any length of time without becoming fouled with current-conducting deposits. Because a cold plug under such conditions will not reach a temperature required to burn off fouling, carbon formation as well as additive particles from the fuel and oil will condense on the comparatively cool surfaces of the insulator to foul the plug and to cause it to misfire.

Spark plugs are customarily supplied in various heat ranges to handle the requirements of individual engines and operating conditions. Heat range refers to the ability of the plug to conduct the heat of combustion away from the electrodes or firing end. A conventional hot-type plug will have a long insulator nose. Because of the length of the heat path, heat thus will be transferred comparatively slowly from the plug firing end to the engine cooling system. A conventional cold-type plug, on the other hand, has a comparatively short insulator nose and heat is transferred rapidly into the engine's cooling system.

Therefore, to overcome the foregoing and other difficulties of the prior art, the general object of this invention is to provide means for varying the heat range of a spark plug automatically to thus keep the plug at the most effective temperature during all operating conditions such that starting, warm-up, idling, low- and high-speed operation of the engine are improved. And, further, to accompany such improvement in engine performance with an efficient spark plug design that reduces the causes of misfiring so that the engine produces greater power and increased fuel economy in all speed ranges.

It is another object of this invention to provide a multiple heat range spark plug whose operating temperature is automatically varied such that the plug runs hot at the lower cylinder temperatures occurring when the engine is idling or at low speeds and loads to thereby inhibit plug fouling, and which runs relatively cool at higher cylinder temperatures such as those occurring under conditions of high speeds and loads so as to prevent the plug overheating that causes auto-ignition and plug electrode burning.

Another object is to provide a spark plug whose design eliminates the requirement for a specific heat range in a plug so that the number of spark plug types required to be manufactured or that have to be stocked by the dealer are thereby reduced. A concomitant object is to provide a spark plug having a multiple heat range such that the selection of a plug with the proper heat range for a specific engine or for the type or service that the engine will encounter will no longer be a problem such that the possibility of fitting plugs of the wrong heat range in an engine with the attendant probability of poor performance and engine damage or owner dissatisfaction is thereby avoided.

Yet another object is to provide a spark plug having automatic means for varying the heat range such that an optimum operating temperature is maintained to thereby minimize the plug fouling that leads to the misfiring which results in engine emissions that contribute heavily to environmental air pollution. In addition, it is an object to provide a plug that will maintain a high standard of performance with engine fuels that have their volatility reduced and have some of their additives and compounds eliminated as a pollution curb.

DESCRIPTION OF THE PRIOR ART

In the prior art, J. E. Genn (U.S. Pat. No. 1,315,298) discloses a spark plug in which an elongated hollow conductor connected with the center electrode contains a small quantity of mercury. Upon becoming heated in operation, the mercury vaporizes, but coming into contact with radiating means in the outer end of the spark plug, the vapor gives off its heat and condenses and the condensed liquid returns by gravity to the heated end of the spark plug where the cycle is repeated. In the prior art also, A. A. Kasarjian (U.S. Pat. No. 2,096,250) discloses a spark plug having a hollow center conductor nearly completely filled with a cooling medium with a small void left to compensate for the thermal expansion of the medium. Upon becoming heated in operation, heat is transferred to cooler parts of the spark plug by conduction and convection. It is clear, therefore, that neither of these prior art references disclose a spark plug with a center conductor with a heat pipe housed in the insulator centerbore such as the construction taught by the present invention. Not having a heat pipe in the center conductor, the spark plug of Genn has to depend on gravity to circulate the condensed vapor, and Kasarjian has to depend on conduction and convection in his spark plug, methods of heat transfer inherently less efficient than heat pipe of the present invention.

There is a teaching in D. Scherenberg et al (U K patent No. GB2025525B) in the prior art of an ignition or pre-combustion chamber device which in one embodiment discloses a barrel-shaped hollow center electrode which serves as a heat pipe for dissipation of heat from the electrode lower end to cooling fins at the terminal end of the device. However, the Scherenberg device is not a spark plug in that it does not have an insulator with a tapered firing end spaced from the bore of the spark plug shell to thereby determine the heat range, thus, the teachings therein are not applicable to spark plugs in which the heat range is automatically controlled such that the firing end operates at a temperature that delivers maximum efficiency.

SUMMARY OF THE INVENTION

In this invention, the heat range of the spark plug is varied automatically by a predetermined evaporative cooling of a substance in a hollow chamber which functions as a dynamic convective heat transfer means such as a heat pipe in the insulator bore or in the center electrode of the spark plug. Although the following exposition of the invention will stress the use of a heat pipe as the dynamic heat transfer means, it will be appreciated that other dynamic convective heat transfer means such as, for example, a reflux condenser can be employed if the application permits. The heat transfer substance can be any element or compound that vaporizes at about the design temperature, approximately 500° C.–900° C., of the spark plug. The spark plug of this invention has a conventional shell which mounts the ground electrode, an insulator containing a center conductor assembly, and a conventional terminal for connection to the ignition system of the engine in which the spark plug is installed. The insulator is more or less conventional except that its longitudinal centerbore may have an enlarged diameter, if required, to accommodate a heat pipe which is one of the elements of the center conductor assembly. The walls of the heat pipe are furnished with capillary grooves or a suitable wicking material. A vaporizable medium is placed in the heat pipe, normally in an amount slightly in excess to that required to completely wet the capillary grooves or the wicking means. An inert non-condensible gas can be introduced into the heat pipe to vary its characteristics. Means associated with the heat pipe are provided for the rapid dissipation of the heat which has been extracted from the firing end of the spark plug.

DESCRIPTION OF THE DRAWINGS

For the purpose of illustrating the invention, there is shown in the drawings the forms which are presently preferred; it should be understood, however, that the invention is not necessarily limited to the precise arrangements and instrumentalities here shown.

FIG. 1 is a front elevational view in longitudinal section of an embodiment of the spark plug of the invention;

FIG. 2 is a fragmentary detail of an alternate design of a component of the spark plug of the invention;

FIG. 3 is a front elevational view in longitudinal section of yet another embodiment of the spark plug of the invention in its operating environment in an engine cylinder head;

FIG. 4 is a fragmentary front elevational view in partial longitudinal section of a design of filling means for the heat transfer means embodied in the invention; and FIGS. 5–7 are fragmentary front elevational views in partial longitudinal section of alternate designs of heat pipes embodied in the invention.

DESCRIPTION OF THE PREFERRED EMBODIMENTS

Referring now to the drawings, the spark plug 10 of the invention embodied in FIG. 1 has a conventional annular metallic shell 12 which has an annular external seat 14 below which is a length of reduced diameter which is externally threaded 16 for installing the spark plug into a threaded bore in the cylinder of an engine with seat 14 in sealing contact on an annular mounting boss on the cylinder head. When so installed, the shell forms an electrical ground. Shell 12 is provided with a bore 18 therethrough with a first section 20 having a shoulder 22 and a second section 24 of reduced diameter. A wrench-engageable head 26 is provided on the shell for threading the spark plug into the engine cylinder head. An elongated electrical insulator 28, which is preferably made of a sintered alumina ceramic is received in the bore of the shell 12. An annular shoulder 30 on the insulator seats it on the shoulder 22 of the shell. An annular sleeve 32 of a relatively soft metal having a high thermal conductivity is interposed between the insulator and the bore of the shell. Sleeve 32 surrounds the insulator in close thermal contact therewith and extends from an insulator upper shoulder 34 to shell shoulder 22 such that the lower end 36 of the sleeve acts to seal the insulator in the shell. Upper end 38 of the sleeve acts to protect the insulator when the upper rim 40 of the shell is turned over to lock the insulator in the shell. Lower length 42 of the insulator is tapered to its firing end 44.

The insulator has a centerbore 46 having a section 48 of a first diameter and a second section 50 of a reduced diameter which tapers to a section 52 of a further reduced diameter receiving the center electrode 54. Center conductor assembly 56 comprises a terminal 58, a center conductor head 60, a heat pipe 62, and the center electrode 54. Terminal 58 is conventionally configured for connection with the ignition system of the engine in which the spark plug is installed. The terminal can be an integral part of the center conductor head which has a conductor shank 64 whose end portion 66 can be threaded for engagement with an interior threaded section 68 in the upper end of the heat pipe 62. The heat pipe is an elongated cylindrical chamber having a side wall 70 and a lower end wall 72. Longitudinal capillary grooves 74 or other suitable wicking means are provided on the side wall. A vaporizable heat pipe medium is placed in the heat pipe, normally in an amount slightly in excess to that required to wet completely the capillary means, and the heat pipe is hermetically sealed by installing an upper end wall or by threading end portion 66 of the center conductor shank into the heat pipe upper end. If a threaded closure is used, the interior volume of the heat pipe can be adjusted selectively by screwing the shank end portion inwardly or outwardly. Appropriate sealing means (not shown) must be used with the threaded closure to insure its hermetic integrity. As is known, an inert non-condensible gas can be introduced into the heat pipe to vary its thermal characteristics. The lower end of the heat pipe at the firing end of the spark plug forms the vaporization zone of the heat pipe and its upper end proximate the center conductor head forms the condensation zone with an adiabatic zone between the two. An annular metallic ring 76 having high thermal conductivity surrounds the heat pipe in intimate thermal contact therewith and the centerbore of the insulator proximate the condensation zone of the heat pipe. The center electrode 54 is positioned in the insulator centerbore section 52 with the firing tip 78 protruding from the firing end 44 of the insulator. A ground electrode 80 welded on the lower rim of the shell is positioned with respect to the center electrode firing tip such that a spark gap 82 is formed therebetween. The center electrode and the lower end of the heat pipe and, if required, its upper end, are embedded in a suitable known fused conductive ceramic or glass seal 84 such that electrical and thermal continuity therebetween is assured.

In operation, except for the thermal control provided by the heat pipe, spark plug 10 performs in a conventional manner to ignite the fuel/air mixture in the engine cylinder. When operating below some specific design temperature, the heat pipe is non-conducting such that the spark plug acts as a conventional "hot" plug with heat from the firing end being required to pass up the lower end of the insulator and, by means of the lower end 36 of the sleeve 32, travel through the shell and thence to the cylinder head of the engine to be dissipated into the cooling system thereof. Because of this relative long heat path, some of it through materials having rather poor thermal conductivity, heat is transferred slowly from the firing end such the plug runs at a temperature which is high enough to burn off fouling deposits even during prolonged periods of idling or low-speed operation. This may be considered to be the "hot" range of the spark plug.

When the operating temperature in the engine cylinder rises above the design point, heat from the firing ends of the center electrode and the insulator supplies heat of vaporization to the heat pipe medium in the vaporizing zone to vaporize it such that the change of state extracts heat from the firing end of the spark plug. The vapor pressure of the vaporization zone increases with vaporization causing vapor to flow to the lower pressure adiabatic zone and thence to the condensation zone. There the vapor is cooled and condenses to give off heat of liquefaction. The condensed medium returns to the vaporization zone by the capillary action of the capillary means such that a circulation that transfers heat from the firing end to the condensation zone is established. As is known, the temperature gradient is very small over the entire length of a heat pipe and a large amount of heat is transferred. Heat from the condensation region of the heat pipe passes through ring 76, then through the insulator wall and by means of the annular sleeve 32 the heat passes to the shell shoulder and thence into the cylinder head of the engine for dissipation therein. A number of air passages 86 opening into the space 88 in the insulator centerbore for the circulation of air for further dissipation of heat from the condensation zone can be provided. A further transfer of heat from the conductor shank portion 64 of the center conductor head can be effected by radiation if a series of annular ribs or fins 92 are provided on the outer diameter of the shank (see FIG. 2). Because of the high thermal conductivity of the heat pipe, heat is transferred rapidly from the firing end such that the temperatures of the spark plug remain relatively low to thereby avoid self-ignition, preignition, and thermal erosion problems. This may be considered to be the "cold" range of the spark plug. Should operating conditions cause engine cylinder temperatures to drop such that the firing end temperatures fall below the design range, the heat pipe will automatically cease to conduct heat. With the heat pipe becoming non-conducting, the spark plug will revert to its "hot" range.

To avoid fouling which occurs at spark plug temperatures below about 900° F., the heat pipe should be designed to become effective at about that temperature, preferably somewhere in the range between 900° F. and 1,100° F., and the working medium and other design parameters should be chosen accordingly.

A further embodiment of the invention is the spark plug 110 shown in FIG. 3. As in the FIG. 1 embodiment, spark plug 110 has a conventional annular shell 112 having an externally threaded lower end of reduced diameter 116 for installing the spark plug in a threaded bore 102 in the cylinder head 104 of an engine which has a system of passages 109 for the circulation of coolant therethrough for cooling the cylinder head. A copper or the like gasket 106 can be interposed between the annular seat 114 of the shell and the cylinder head mounting boss 108 to provide good heat transfer and to prevent the blow-by of engine combustion gases. It is known also to employ a conical or tapered seat on the spark plug shell such that a gasket is not required. Shell 112 is provided with a bore 118 having a first section 120 having an annular shoulder 122 and a lower section of reduced diameter 124. The shell has the usual wrench-engageable head 126 for installing the spark plug for operation in an engine. An elongated electrical alumina insulator 128 is received in the bore of the shell. The insulator has an annular shoulder 130 to seat it on shoulder 122 of the shell and a second upper annular shoulder 134. An annular sleeve 132 of a relatively soft metal such as copper having a high thermal conductivity is interposed between the insulator and the bore of the shell. Sleeve 132 surrounds the insulator in close thermal contact therewith and extends from insulator upper shoulder 134 to shell shoulder 122 such that the sleeve lower end 136 acts to seal the insulator in the shell. Upper end 138 of the sleeve acts to protect the insulator when the upper rim 140 of the shell is turned over to lock the insulator in the shell. As is the usual practice, the upper end of the insulator extends out of the shell and its lower end portion 142 is tapered and spaced from the lower bore of the shell. A series of ribs 144 to increase the electrical leakage path can be provided on the upper portion of the insulator. It will be noted that spark plug 110 does not have an annular metallic ring such as ring 76 of spark plug 10, but the side wall of the heat pipe is in thermal contact with the wall of section 148 of the insulator centerbore. As is known, the alumina or other ceramic used in the construction of insulator 128 is an excellent electrical insulator but its thermal conductivity is low. To improve the heat dissipation properties of the construction, an annular section 186 in the waist of the insulator proximate the condensation zone of the heat pipe is reduced in diameter such that the thickness of the insulator wall in that region is reduced to a minimum consistent with the electrical insulation requirements of the insulator. The necked-in annular section 186 is filled in with a suitable material 190 having the requisite strength properties and a high thermal conductivity. For example, the material may be a glass or ceramic loaded with a powered copper or nickel filler such that optimum heat transfer characteristics are obtained. Heat and pressure or an isostatic pressing process can be employed to compact the material to give it the required strength. It will be appreciated that the distribution and amount of material 190 can differ from that shown.

The insulator has a centerbore 146 which has a section of a first diameter 148 which tapers to a section 152 of further reduced diameter. Center conductor assembly 156 comprises the terminal 158, the center conductor head 160, a heat pipe 162, and a center electrode 154. Center conductor head 160 has a conductor shank 164 whose end portion 166 can be in a threaded engagement with an interior threaded portion 168 in the upper end section of the heat pipe 162. The heat pipe is a cylindrical elongated chamber having side walls 170 and a lower end wall 172. Longitudinal capillary grooves 174 or other suitable wicking means are provided on the heat pipe side walls. As is the usual practice, a vaporizable heat pipe medium is placed in the heat pipe, normally in an amount slightly in excess of that required to wet completely the capillary means, and the heat pipe is hermetically sealed by installing an upper end wall or by threading end portion 166 of the center conductor shank into the heat pipe upper end. If a threaded closure is used, appropriate sealing means (not shown) must be used to insure its hermetic integrity. As is known, an inert non-condensible gas can be introduced into the heat pipe to vary its thermal characteristics. As in the FIG. 1 embodiment, the lower portion of the heat pipe forms the vaporization zone, the upper portion forms the condensation zone and there is an adiabatic zone therebetween. When an inert non-condensible gas is used in the heat pipe, it will be understood that an additional volume will be provided above the condensation zone to act as a reservoir for the gas. The center electrode 154 is positioned in the insulator centerbore section 152 with the firing tip 178 protruding from the firing end 144 of the insulator. A ground electrode 180 welded on the lower rim of the shell is positioned with respect to the center electrode firing tip such that a spark gap 182 is formed therebetween. The center electrode and the lower end of the heat pipe are embedded in a suitable known conductive ceramic or glass seal 184 such that the electrical and thermal conductivity of the center conductor assembly is assured.

The operation of this embodiment is essentially similar to that of the FIG. 1 spark plug 10 embodiment and reference should be made to the description thereof for an understanding of how the heat pipe automatically varies the operative heat range of the spark plug to insure optimum operating performance. In this embodiment, when the spark plug is above its design temperature and the heat pipe is operating, the heat of liquefaction from the condensation zone of the heat pipe is conducted through the thin wall of the insulator into high-conduction material 190 and thence into annular sleeve 132, where it is transferred into the shell and through seat 114 and gasket 106 into the engine cylinder head for dissipation into the cooling system therein. As in the FIG. 1 embodiment, a number of air passages in the center conductor head which open into the centerbore section 188 can be provided such that a circulation of air that transfers heat by convection from the condensation zone and components can be established. A further transfer of heat from the lower shank portion 168 of the center conductor head can be furnished by radiation by the use of a series of annular ribs or radial radiating fins are provided on the outer diameter of the shank (as indicated in FIG. 2).

FIG. 4 illustrates the upper portion of a spark plug 210 of the invention showing means that can be provided to fill the dynamic convective heat transfer means which can be a heat pipe or a reflux condenser with the vaporizable medium and, if such is used, an inert non-condensible gas. In this design, the upper end of the conductor shank 264 of the centerconductor head is a threaded fit into a threaded bore 263 in the terminal 258 which has a lower end portion 259 received into the upper end section of centerbore 246 of the insulator 228. Threaded lower end section 266 of the conductor shank is suitably installed as by a threaded connection into the upper end of the heat pipe 262. The conductor shank in this design is tubular with a centerbore 265 extending along its length and has a soft metal filling tube 267 received in the centerbore with its upper end 269 extending therefrom. The bore 271 of filling tube 267 can be of a size fitting a suitable heat pipe filling means (not shown). To fill the heat pipe, the heat pipe filling means injects a charge of the required heat pipe constituents into the filling tube where it passes through centerbore 265 and into the heat pipe. Following the charging of the heat pipe, the end of the filling tube is pinched or crimped securely closed and may be soldered as is the usual practice. Centerbore 265 can be of a suitable size to serve as a partial reservoir for the inert, non-condensible gas, if such is used in the heat pipe.

FIG. 5 illustrates another embodiment of the spark plug of the invention. Spark plug 310 has a shell 312, an elongated insulator 328, annular sleeve 332, and the like substantially identical to those of the FIG. 3 spark plug 110. It differs from that embodiment in that the lower section 348 of insulator centerbore 346 forms the chamber of the heat pipe 362. Thus, the tubular conductor shank 364 of the center conductor assembly has a circular transverse end flange 369 which forms the upper end wall of the heat pipe 362. A threaded connection 367 can be provided between shank 364 and flange 369 such that the volume of the heat pipe can be varied thereby. Centerbore 365 of the center conductor shank serves as the filling aperture of the heat pipe. A lower end wall (not shown) can be provided for the heat pipe should the requirements so dictate. Suitable electrically and thermally conductive sealing means 384 are used to fix the center electrode 354, and end flange 369 and conductor shank 364 in their proper operating position and to hermetically seal the heat pipe defined in the insulator centerbore. The walls of the insulator centerbore lower section which form the heat pipe side walls are provided with electrically conducting capillary wicking means 374. In this embodiment, the current path from the terminal is through center conductor head, conductor shank 364 and flange 369, then through the wicking 374 and through the sealing means 384 to the center electrode. In operation, spark plug 310 of this embodiment operates identically with the previously described embodiments with the exception that condensation in the heat pipe takes place directly on the insulator centerbore wall such that the heat transfer characteristics of the device are improved.

Yet another embodiment 410 of the spark plug of the invention is illustrated in FIG. 6. As in the immediately preceding embodiment, spark plug 410 has a shell 412, an elongated insulator 428, annular sleeve 432, and the like substantially identical to those of the FIG. 5 spark plug 310. As in the FIG. 5 embodiment, the lower section 448 of the insulator centerbore 446 forms the chamber of the heat pipe 462. In this embodiment, the conductor shank 464 of the center conductor assembly extends through the heat pipe chamber and has a circular transverse end flange 471 which forms the lower end wall of the heat pipe and an upper circular transverse flange 469 which forms the upper end wall of the heat pipe. Centerbore 465 of the center conductor and a transverse passage 466 serve as the filling means for the heat pipe. Suitable wicking means 474 are provided on the walls of the heat pipe section of the insulator centerbore 446. Suitable electrically and thermally conducting sealing means 484 are used to seal the assembly and fix the components in place. The characteristics of spark plug 410 are identical to the FIG. 5 embodiment except that non-electrically conducting wicking means 474 can be employed because the center conductor shank provides an electrical current path to the center electrode.

A further embodiment 510 of the spark plug of the invention is shown in FIG. 7. As in the previously described embodiment, spark plug 510 has a shell 512, an elongated insulator 528, annular sleeve 532, and the like substantially identical to those of the FIG. 5 spark plug 310. As in that embodiment, the lower section 548 of the insulator centerbore 546 forms the chamber of the heat pipe 562 and the conductor shank 564 of the center conductor assembly extends through the heat pipe chamber and has a circular transverse flange 569 which forms the upper end wall and a second circular transverse end flange 571 which forms the lower end wall of the heat pipe. In this embodiment, the walls of section 548 of the insulator centerbore do not have wicking means. Instead of a wall wick, capillary grooves 574 or other suitable wicking means are provided on the peripheral surface of the center conductor lower shank 564 and the under surface 567 of flange 569 which acts as the upper end wall of the heat pipe has a suitable thickness of wicking means 575. The parameters of wicking means 574 and 575 are selected such that the capillary pumping requirements of the heat pipe are satisfied. Suitable electrically and thermally conducting sealing means 584 are used to seal the assembly and to fix the components in place. Centerbore 565 of the center conductor and a transverse passage 566 connecting into the centerbore serve as the filling means for the heat pipe.

It will be appreciated that any feature shown herein for a certain embodiment can be used where applicable with any of the other embodiments. In this exposition, the emphasis has been on spark plugs; however, it will be recognized that the advantages of this invention apply equally to other sparking devices such as spark igniters and the like. In this exposition, also, emphasis has been placed on the use of a heat pipe for the dynamic heat transfer means; however, as has been pointed out previously herein, a reflux condenser type convective heat transfer means can be employed in applications where the sparking device is mounted vertically in an upright orientation such that gravity will return the condensate to the evaporation zone at the firing end whose operating temperature is being maintained. In such design when the design temperature is exceeded, the working medium at the firing end vaporizes such that its change of state extracts heat therefrom. The vapor moves by vapor pressure to a region of lower temperature where it condenses on the wall bounding that region to release its heat by a change of state. The condensate flows back by gravity to the vaporization zone where the cycle is repeated as long as the design temperature is exceeded. It will be recognized that, inasmuch as gravity is depended upon to return the condensate to the vaporization zone, it is not required to provide capillary wicking to perform that function. Thus, as illustrated in FIG. 4, the walls of the insulator centerbore 246 need not be provided with capillary wicking means if the design employs a reflux condenser as the heat transfer means. The same condition applies if the bore of the center conductor rather than the insulator centerbore is utilized as the dynamic heat transfer means. Therefore, where a reflux condenser means of heat transfer is used in a design such as, for example, the embodiment 310 of the spark plug of the invention shown in FIG. 5 wherein electrical continuity from the terminal to the center electrode is ensured by the use of an electrically conductive capillary wicking 374, the capillary wicking is not required and the wall of the insulator centerbore 346 will be furnished with a conductive coating of metal or the like to provide electrical continuity for the sparking current between the terminal and the center electrode.

Although shown and described in what are believed to be the most practical and preferred embodiments, it is apparent that departures from the specific methods and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

I claim:

1. An internal combustion engine spark plug embodying dynamic convective heat transfer means for automatically varying its operative heat range according to changes in the combustion temperatures within the engine, said spark plug having a terminal end and an inner firing end and comprising an annular metal shell carrying a ground electrode and having external threads for installing said spark plug for operation in an engine, an electrical insulator received in said shell with the insulator inner end nose portion being tapered and in a radially spaced relationship with the bore of said shell, a center conductor assembly received in a centerbore in said insulator, said center conductor assembly having at least said electrical terminal, a center conductor shank, a heat pipe, means for filling said heat pipe, and a center electrode having a firing end positioned with respect to said ground electrode such that a spark gap is formed therebetween, said heat pipe being hermetically sealed and containing a vaporizable heat pipe medium and having a vaporization zone and a condensation zone with an adiabatic zone therebetween, wicking means extending from said condensation zone to said vaporization zone, heat transferring means in thermal contact with said condensation zone for extracting heat therefrom for dissipation substantially into said engine, said heat pipe being thermally non-conducting below a design temperature such that said spark plug firing end runs hot to burn off fouling deposits settling thereon, and said heat pipe being thermally conducting above said design temperature to conduct heat rapidly away from said firing end such that the overheating thereof is avoided.

2. The spark plug defined in claim 1 wherein the walls of the insulator centerbore form the side walls of the heat pipe and said heat pipe has capillary means running the length thereof, means defining upper and lower walls of said heat pipe and means providing electrical continuity between the terminal end and firing end of said spark plug.

3. The spark plug defined in claim 2 wherein the upper and lower wall means and the capillary means are electrically conducting and wherein the capillary means are on the walls of the heat pipe.

4. The spark plug defined in claim 2 wherein the center conductor shank extends through the heat pipe to provide electrical continuity between the terminal end and the firing end and wherein the capillary means are on the walls of the heat pipe.

5. The spark plug defined in claim 2 wherein the center conductor shank extends through the heat pipe to provide electrical continuity between the terminal end and the firing end and wherein the capillary means are on said center conductor shank and at least on the inside surface of the upper wall of said heat pipe.

6. The spark plug defined in claim 2 wherein the center conductor shank has an axial bore in fluid communication with the heat pipe and wherein filling means associated with said axial bore are provided for filling said heat pipe.

7. The spark plug defined in claim 2 wherein the cylinder head of the engine is furnished with cooling means providing a heat sink for said spark plug and the heat transferring means comprises a tubular sleeve of high thermal conductivity enclosing said insulator in intimate thermal contact therewith, said sleeve extending from the region of said insulator proximate said heat pipe condensation zone to the bore of said shell proximate the region of said shell seating on said cylinder head whereby a thermal path of high conductivity from said heat pipe to said heat sink is provided.

8. A spark plug for internal combustion engines, said spark plug having a terminal end and an inner firing end and comprising an annular metal shell carrying a ground electrode and having external threads for installing said spark plug for operation in an engine, an electrical insulator receiving in said shell with the insulator inner end nose portion being tapered and in a radially spaced relationship with the bore of said shell, a center conductor assembly received in a centerbore in said insulator, said center conductor assembly having at least said electrical terminal, a center conductor shank, a heat pipe, means for filling said heat pipe, and a center electrode having a firing end position with respect to said ground electrode such that a spark gap is formed therebetween, said heat pipe being hermetically sealed and containing a vaporizable heat pipe medium and having a vaporization zone and a condensation zone with an adiabatic zone therebetween, wicking means extending from said condensation zone to said vaporization zone, heat transferring means in thermal contact with said condensation zone for extracting heat therefrom for dissipation substantially into said engine, said electrical insulator being a relatively poor thermal conductor and having an annular necked-in region proximate said heat pipe condensation zone to reduce the thickness of relatively poor thermal conducting material in the path of heat dissipation from said heat pipe, said necked-in region being built up with a relatively good thermally conducting material, an annular sleeve of thermally conductive material interposed between said shell and said insulator in good thermal contact therewith, the lower end of said sleeve sealing said insulator in said shell, said heat pipe being thermally non-conducting below a design temperature such that said spark plug firing end runs hot to burn off fouling deposits settling thereon, said heat pipe being thermally conducting above said design temperature to conduct heat rapidly away from said firing end such that the overheating thereof is avoided.

9. The spark plug defined in claim 8 wherein the walls of the insulator centerbore form the side walls of the heat pipe and said heat pipe has capillary means running the length thereof, means defining upper and lower walls of said heat pipe, and means providing electrical continuity between the terminal end and firing end of said spark plug.

10. The spark plug defined in claim 8 wherein the upper and lower wall means and the capillary means are electrically conducting and wherein the capillary means are on the walls of the heat pipe.

11. The spark plug defined in claim 8 wherein the center conductor shank extends through the heat pipe to provide electrical continuity between the terminal end and the firing end and wherein the capillary means are on the walls of the heat pipe.

12. The spark plug defined in claim 8 wherein the center conductor shank extends through the heat pipe to provide electrical continuity between the terminal end and the firing end and wherein the capillary means are on said center conductor shank and at least on the inside surface of the upper wall of said heat pipe.

13. The spark plug defined in claim 8 wherein the center conductor shank has an axial bore in fluid communication with the heat pipe and wherein filling means associated with said axial bore are provided for filling said heat pipe.

14. A spark plug comprising an upper terminal end and a lower firing end adapted to be installed in the cylinder head of an engine, said spark plug including an annular metal shell with external threads proximate the firing end thereof for installing said spark plug for operation in said cylinder head, an elongated electrical insulator having its lower end received in the bore of said shell and including a nose portion spaced radially inwardly from said shell bore, means for sealing said insulator in a gas-tight relationship in said shell, an elongated center conductor assembly received in a centerbore in said insulator, said center conductor assembly comprising an electrical terminal, a center conductor head having a lower shank, a heat pipe, and a center electrode, said center electrode having a firing end positioned at the firing end of said insulator, said shell having ground electrode means disposed in an operative relationship with said firing end of said center electrode and forming a spark gap therebetween, means for sealing said center conductor assembly in a gastight relationship in said insulator, said electrical terminal being located at the upper end of said center conductor assembly for connecting said spark plug to the ignition system of said engine, said heat pipe being hermetically sealed and containing a vaporizable heat pipe medium, and having a vaporization zone near the firing end of said spark plug and a condensation zone distal therefrom with an adiabatic zone therebetween, capillary means extending from said vaporization zone to said condensation zone, heat transferring means in thermal contact with said condensation zone for extracting heat from said heat pipe for dissipation therefrom, said heat pipe being thermally non-conducting below a design temperature range, said vaporizable medium vaporizing above said design temperature such that its change of state extracts heat from said firing end, said vapor moving by vapor pressure to said condensation zone and condensing to release its heat by a change of state, the condensed medium returning by the capillarity of said capillary means to said vaporization zone, such that a circulation that transfers heat from said firing end is established when spark plug temperatures exceed said design temperature, said circulation ceasing below said design temperature to render the heat pipe thermally non-conducting, whereby said heat pipe controls the operative heat range of said spark plug automatically.

15. The spark plug defined in claim 14 wherein the cylinder head of the engine is furnished with cooling means providing a heat sink for said spark plug and the heat transferring means comprises a tubular sleeve of high thermal conductivity enclosing said insulator in intimate thermal contact therewith, said sleeve extending from the region of said insulator proximate said heat pipe condensation zone to the bore of said shell proximate the region of said shell seating on said cylinder head whereby a thermal path of high conductivity from said heat pipe to said heat sink is provided.

16. The spark plug defined in claim 15 wherein the bore of the spark plug shell has an annular shoulder intermediate its ends associated with an annular shoulder on the outside diameter of the insulator and wherein the lower end portion of the tubular sleeve is interposed between said annular shoulders on said insulator and said shell to provide a gas-tight seal therebetween.

17. The spark plug defined in claim 14 wherein means are provided for varying selectively the volume of the heat pipe such that its thermal characteristics can be varied.

18. The spark plug defined in claim 17 wherein the elongated center conductor has a lower heat pipe end and an upper terminal end and wherein the means for varying selectively the volume of the heat pipe are a threaded portion in the bore of the upper condenser end of said heat pipe and the threaded portion in the lower end of said upper terminal end, said lower end of said upper terminal end being threaded into said upper condenser end such that said terminal end can be screwed inwardly or outwardly to thereby vary the volume of said heat pipe.

19. An internal combustion engine spark plug embodying dynamic convective heat transfer means for automatically varying its operative heat range according to changes in the combustion temperatures within the engine, said spark plug having an outer electrical terminal end and an inner firing end and comprising an annular metal shell carrying a ground electrode and having external threads for installing said spark plug for operation in an engine, an electrical insulator received in said shell with the insulator inner end nose portion being tapered and in a radially spaced relationship with the bore of said shell, a center conductor assembly received in a centerbore in said insulator, said center conductor assembly having at least said electrical terminal, a center conductor shank, reflux condenser heat transfer means, means for filling said reflux condenser, and a center electrode having a firing end positioned with respect to said ground electrode such that a spark gap is formed therebetween, means providing electrical continuity between said conductor shank and said center electrode, said reflux condenser being hermetically sealed and containing a vaporizable heat transfer medium and having a vaporization zone and a condensation zone with an adiabatic zone therebetween, heat transferring means in thermal contact with said condensation zone for dissipating heat therefrom substantially into said engine, said vaporizable medium in operation vaporizing above a design temperature such that its change of state extracts heat from said firing end, said vapor moving by vapor pressure to said condensation zone and condensing to release its heat by its change of state, the condensed vapor returning by gravity to said vaporization zone, such that a circulation that transfers heat from said firing end is established in operation when spark plug temperatures exceed said design temperature, said circulation ceasing below said design temperature to render the reflux condenser thermally non-conductive, whereby said reflux condenser controls the operative heat range of said spark plug automatically.

20. The spark plug defined in claim 19, wherein the walls of the insulator centerbore form the side walls of the reflux condenser, and means define upper and lower walls of said reflux condenser.

21. The spark plug defined in claim 20, wherein the means providing electrical continuity between said conductor shank and said center electrode is a conductive coating on the walls of the insulator centerbore.

22. The spark plug defined in claim 19, wherein the center conductor shank extends through the reflux condenser to provide electrical continuity between the terminal end and the firing end.

23. The spark plug defined in claim 19, wherein the means for firing the reflux condenser are axial bore means in said center conductor assembly in fluid communication with said reflux condenser.

24. The spark plug defined in claim 19, wherein means are provided for varying selectively the volume of the reflux condenser such that its thermal characteristics can be varied.

25. The spark plug defined in claim 24, wherein the elongated center conductor has a lower reflux condenser end and an upper outer electrical terminal end and wherein the means for varying selectively the volume of the reflux condenser are a threaded portion in the bore of the upper condensation zone end of said reflux condenser and a threaded portion in the lower end of said upper terminal end, said lower end of said upper terminal end being threaded into said upper condensation zone end such that said terminal end can be screwed inwardly or outwardly to thereby vary the volume of said reflux condenser.

* * * * *